US010718292B2

(12) United States Patent
Harada

(10) Patent No.: US 10,718,292 B2
(45) Date of Patent: Jul. 21, 2020

(54) CYLINDER BLOCK STRUCTURE OF ENGINE

(71) Applicant: HONDA MOTOR CO., LTD., Tokyo (JP)

(72) Inventor: Toru Harada, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/516,728

(22) Filed: Jul. 19, 2019

(65) Prior Publication Data

US 2020/0025126 A1 Jan. 23, 2020

(30) Foreign Application Priority Data

Jul. 23, 2018 (JP) ..... 2018-137589

(51) Int. Cl.
*F02F 1/42* (2006.01)
*F02F 7/00* (2006.01)

(52) U.S. Cl.
CPC ..... *F02F 7/0012* (2013.01); *F02F 7/0021* (2013.01); *F02F 7/0053* (2013.01)

(58) Field of Classification Search
CPC ..... F16F 15/265; F16F 15/267; F16F 15/264; F01M 2001/0276; F02B 67/04
USPC ..... 123/193.5
See application file for complete search history.

(56) References Cited

U.S. PATENT DOCUMENTS 5,535,643 A * 7/1996 Garza ..... F02B 67/04 123/192.2
6,189,499 B1 * 2/2001 Iwata ..... F16F 15/265 123/192.2
6,205,970 B1 * 3/2001 Iwata ..... F02B 75/20 123/192.2
6,382,165 B1 * 5/2002 Hirose ..... F16F 15/264 123/192.2
6,880,512 B2 * 4/2005 Hashimoto ..... F02B 67/04 123/192.2
8,468,995 B2 * 6/2013 Jacques ..... F16F 15/265 123/192.2

(Continued)

FOREIGN PATENT DOCUMENTS

JP 61-138851 U 8/1986
JP 1-88047 U 6/1989

(Continued)

OTHER PUBLICATIONS

Office Action dated Mar. 25, 2020, issued in counterpart JP Application No. 2018-137589, with English translation (8 pages).

*Primary Examiner* — Long T Tran
*Assistant Examiner* — James J Kim
(74) *Attorney, Agent, or Firm* — Westerman, Hattori, Daniels & Adrian, LLP

(57) ABSTRACT

Recesses are formed in edge portions of a bearing cap bridge from second fastening portions toward first fastening portions, and when seen in an orthogonal direction to the cylinder block bottom wall, third fastening portions that fasten an engine auxiliary device driven by a crankshaft to the cylinder block bottom wall are arranged in spaces R1 to R4 that are demarcated by first imaginary lines L1, which pass through the second fastening portions and are orthogonal to a crankshaft axial line A, and outlines of the recesses.

3 Claims, 3 Drawing Sheets

(56) References Cited

U.S. PATENT DOCUMENTS

| | | | | |
|---|---|---|---|---|
| 8,857,400 | B2 * | 10/2014 | Akaishi | F02B 75/065 123/192.1 |
| 2005/0268877 | A1 * | 12/2005 | Hashimoto | F01M 1/02 123/192.2 |
| 2007/0065059 | A1 * | 3/2007 | Johnson | F02B 75/06 384/294 |
| 2015/0075477 | A1 * | 3/2015 | Kitamura | F16F 15/267 123/192.2 |

FOREIGN PATENT DOCUMENTS

| | | | |
|---|---|---|---|
| JP | 10-121930 | A | 5/1998 |
| JP | 11-218118 | A | 8/1999 |
| JP | 2002-250399 | A | 9/2002 |
| JP | 2005-282467 | A | 10/2005 |
| JP | 2007-23901 | A | 2/2007 |
| JP | 2009-180210 | A | 8/2009 |
| JP | 2015-117628 | A | 6/2015 |
| JP | 2015-117629 | A | 6/2015 |
| JP | 2015-194099 | A | 11/2015 |

* cited by examiner

CYLINDER BLOCK STRUCTURE OF ENGINE

CROSS REFERENCES TO RELATED APPLICATIONS

The present application claims priority under 35 U.S.C. § 119 to Japanese Patent Application No. 2018-137589, filed Jul. 23, 2018, entitled "Cylinder Block Structure of Engine." The contents of this application are incorporated herein by reference in their entirety.

BACKGROUND

1. Field

The present disclosure relates to a cylinder block structure of an engine, the cylinder block structure which includes a cylinder block, plural bearing caps which support a crankshaft by interposing the crankshaft between the cylinder block and the plural bearing caps, and a bearing cap bridge which integrally couples the plural bearing caps and in which the bearing cap bridge is fastened to the cylinder block together with the plural bearing caps by first fastening portions and is fastened to a cylinder block bottom wall by second fastening portions.

2. Description of the Related Art

Such a cylinder block structure of an engine has been disclosed by Japanese Unexamined Patent Application Publication No. 2005-282467. Japanese Unexamined Patent Application Publication No. 2005-282467 describes that in this cylinder block structure, a cap bolt 18 that fastens a bearing cap bridge (bearing cap beam) 16 and a bearing cap 15 together to a skirt portion 12 of a cylinder block 11 is arranged as close as possible to a beam bolt 17 that fastens the bearing cap bridge 16 to the skirt portion 12 of the cylinder block 11, rigidity of the cylinder block 11 is thereby improved, and inclination of the bearing cap 15 in a crankshaft axial line direction is effectively inhibited.

SUMMARY

Incidentally, in a case where a balancer device that reduces engine vibration is mounted on a lower portion of a cylinder block, in the above related art, a large portion of a split surface of a skirt portion 12 of a cylinder block 11 (a fastened surface to an oil pan 20) is covered by a bearing cap bridge 16. Thus, the balancer device may not directly be fastened to the split surface of the skirt portion 12 and has to be fastened to a lower surface of the bearing cap bridge 16. Thus, compared to a case where the balancer device is directly fastened to the split surface of the skirt portion 12 (a bottom wall of the cylinder block), mounting rigidity of the balancer device lowers, possibly causing vibration to occur.

It is desirable to tightly fasten an engine auxiliary/accessory device to a bottom wall of a cylinder block without interference with a bearing cap bridge.

A first aspect of the present disclosure suggests a cylinder block structure of an engine, the cylinder block structure including: a cylinder block; plural bearing caps that support a crankshaft by interposing the crankshaft between the cylinder block and the plural bearing caps; and a bearing cap bridge that integrally couples the plural bearing caps. The bearing cap bridge is fastened to a cylinder block bottom wall together with the plural bearing caps by first fastening portions and is fastened to the cylinder block bottom wall by second fastening portions. Recesses are formed in edge portions of the bearing cap bridge from the second fastening portions toward the first fastening portions and when seen in an orthogonal direction to the cylinder block bottom wall, third fastening portions that fasten an engine auxiliary/accessory device driven by the crankshaft to the cylinder block bottom wall are arranged in spaces that are demarcated by first imaginary lines, which pass through the second fastening portions and are orthogonal to a crankshaft axial line), and outlines of the recesses.

In a configuration of the first aspect, the plural bearing caps are integrally coupled by the bearing cap bridge, and rigidity against inclination may thereby be enhanced.

It becomes possible to directly fasten the third fastening portions to the cylinder block bottom wall without interference with the bearing cap bridge, the engine auxiliary device as a vibration source is tightly fastened to the cylinder block bottom wall with high rigidity, and vibration may thereby effectively be reduced.

Further, in addition to the configuration of the first aspect, a second aspect of the present disclosure suggests the cylinder block structure of an engine in which when seen in the orthogonal direction to the cylinder block bottom wall, the second fastening portions may be offset from second imaginary lines that pass through the first fastening portions and are orthogonal to the crankshaft axial line.

In a configuration of the second aspect, the positions of the first fastening portions and the second fastening portions are not locally concentrated but are dispersed, fastening rigidity of the engine auxiliary device to the cylinder block bottom wall is further enhanced, and vibration may thereby be reduced.

Further, in addition to the configuration of the first or second aspect, a third aspect of the present disclosure suggests the cylinder block structure of an engine in which the engine auxiliary device may be a balancer device or an oil pump.

In a configuration of the third aspect, vibration of the balancer device or the oil pump as a vibration source may effectively be reduced.

Note that a balancer device 19 of an embodiment corresponds to the engine auxiliary device of the present disclosure.

DESCRIPTION OF THE PREFERRED EMBODIMENTS

An embodiment of the present disclosure will hereinafter be described based on FIG. 1 to FIG. 3. Note that herein, a cylinder head side of an engine is defined as an upper side, and an oil pan side is defined as a lower side.

Figure 1:
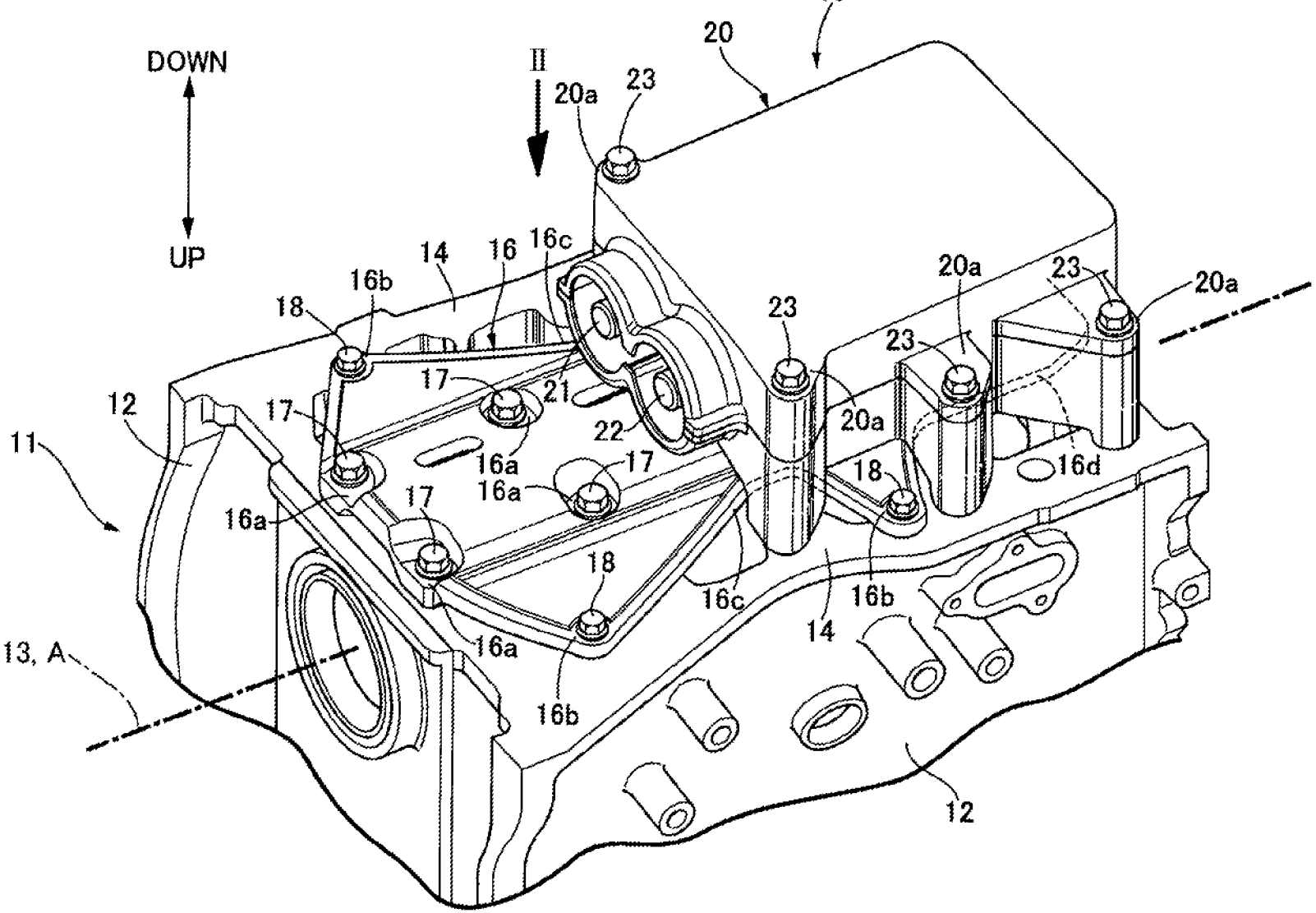
FIG. 1 is a perspective diagram of a cylinder block of an engine as seen from an obliquely lower side.
Figure 2:
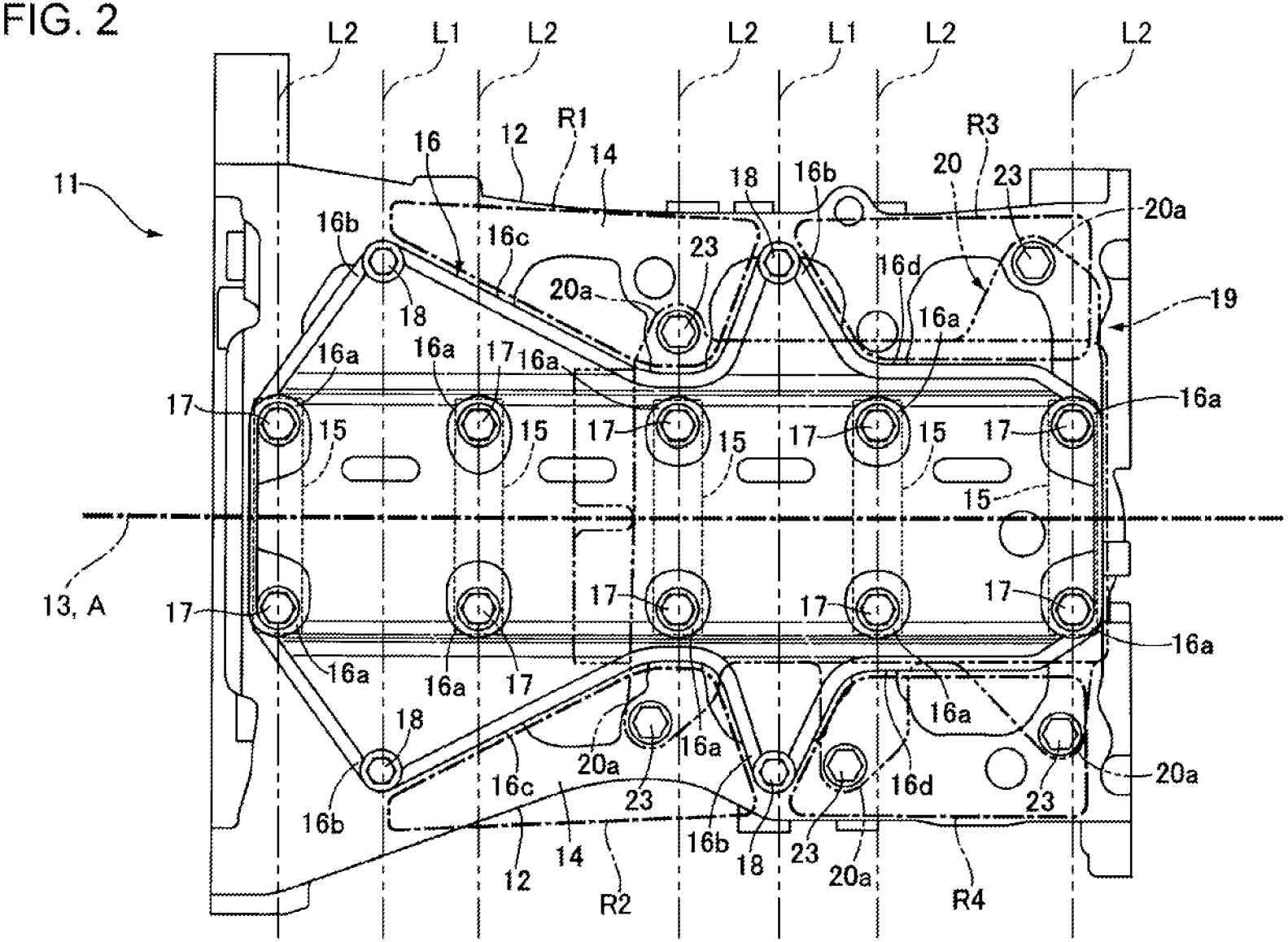
FIG. 2 is a diagram of FIG. 1 viewed from the direction of arrow II.
Figure 3:
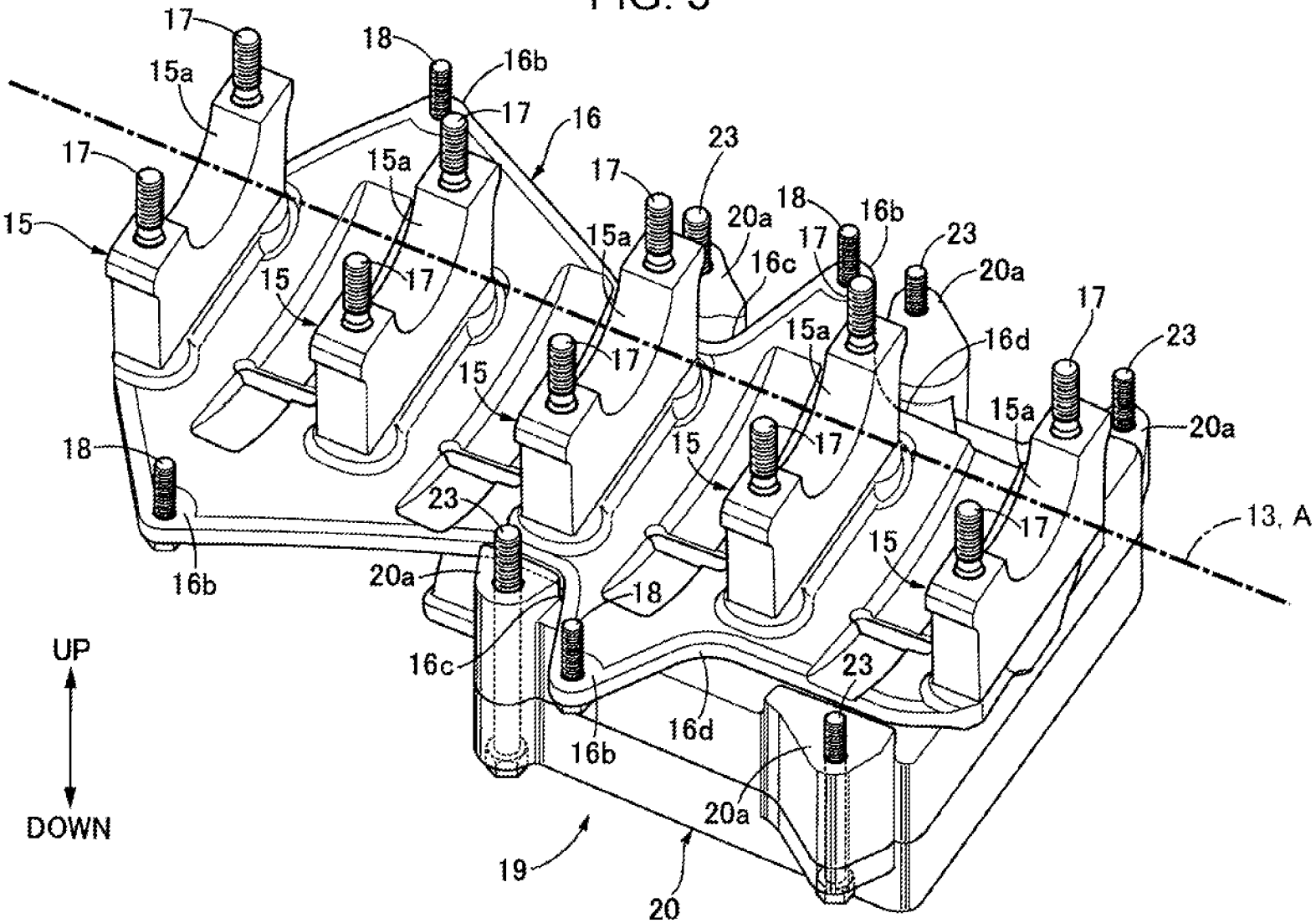
FIG. 3 is a perspective diagram of bearing caps, a bearing cap bridge, and a balancer device.

As illustrated in FIG. 1 to FIG. 3, a skirt portion 12 that configures a crankcase is formed in a lower portion of a cylinder block 11 of an in-line four-cylinder engine, and five journals of a crankshaft 13 are supported by five journal support portions (not illustrated) formed in the skirt portion 12. In FIG. 1 to FIG. 3, the crankshaft 13 is indicated by a chain line as crankshaft axial line A.

Five bearing caps 15 are fixed to the five journal support portions, which support the journals of the crankshaft 13, from a cylinder block bottom wall 14 side, and the crankshaft 13 is rotatably supported while being interposed between the journal support portions of the skirt portion 12 and semicircular support surfaces 15*a* of the bearing caps 15.

A plate-like bearing cap bridge 16 that extends in a crankshaft axial line A direction integrally couples lower surfaces of the five bearing caps 15. Five pairs of first fastening portions 16*a* between which axial line A of the crankshaft 13 is interposed are formed in the bearing cap bridge 16, and first bolts 17 that respectively pass through those five pairs of first fastening portions 16*a* pass through the bearing caps 15 and are fastened to the journal support portions of the skirt portion 12. In such a manner, the five bearing caps 15 and the bearing cap bridge 16 are together fastened to the skirt portion 12 of the cylinder block 11 by the 10 first bolts 17.

In addition, two second fastening portions 16*b* are formed in each of both side edges of the bearing cap bridge 16 between which crankshaft, axial line A is interposed, and four second bolts 18 that pass through those four second fastening portions 16*b* are fastened to the flat cylinder block bottom wall 14 only at a lower end of the skirt portion 12 in positions away from the bearing caps 15 in a direction orthogonal to the crankshaft axial line A, i.e., in which the bearing caps 15 are not present (FIG. 2).

Further, a balancer device 19 for reducing engine vibration is mounted on a lower side of the bearing cap bridge 16. The balancer device 19 has two balancer shafts 21 and 22 that are rotatably supported by a housing 20 and are rotated by a driving force of the crankshaft 13 and are fastened to the cylinder block bottom wall 14 by two third bolts 23 that pass through two third fastening portions 20*a* provided in one side edge of the housing 20 and by three third bolts 23 that pass through three third fastening portions 20*a* provided in the other edge of the housing 20.

That is, two recesses 16*c* and 16*d*, which are notched from the two neighboring/adjacent second fastening portions 16*b* toward the first fastening portion 16*a* side, are formed as shaping inwardly-recessed outlines along each of the side edges of the bearing cap bridge 16, thereby making cutout, opened spaces between the second fastening portions 16*b* or adjacent some of second fastening portions 16*b*. When the cylinder block bottom wall 14 is seen from the oil pan side toward the cylinder head side, two spaces R1 and R2 are demarcated by two first imaginary lines L1, which connect the second fastening portions 16*b* forming respective pairs and are orthogonal to crankshaft axial line A, and the two recesses 16*c*. One third bolt 23 of the five third bolts 23 is arranged in one space R1, and one third bolt 23 of the five third bolts 23 is arranged in the other space R2.

Further, two spaces R3 and R4 are demarcated by one first imaginary line L1 and the two recesses 16*d*. One third bolt 23 of the five third bolts 23 is arranged in one space R3, and two third bolts 23 of the five third bolts 23 are arranged in the other space R4.

In addition, when the cylinder block bottom wall 14 is seen from the oil pan side toward the cylinder head side, five second imaginary lines L2, which respectively connect the five pairs of first fastening portions 16*a* and are orthogonal to crankshaft axial line A, do not overlap with the two first imaginary lines L1 but are offset in the crankshaft axial line A direction.

Next, a description will be made about work of the embodiment of the present disclosure that includes the above configuration.

The five bearing caps 15 that, cooperatively support the crankshaft 13 with the journal support portions of the skirt portion 12 of the cylinder block 11 are integrally coupled by the bearing cap bridge 16. Thus, rigidity against inclination may be enhanced by reinforcing the five bearing caps 15 by the bearing cap bridge 16.

In a case where the balancer device 19 is mounted on the lower side of the cylinder block bottom wall 14 as a lower surface of the cylinder block 11 and hypothetically the bearing cap bridge 16 does not include the recesses 16*c* and 16*d*, the third bolts 23 interfere with the bearing cap bridge 16, and the balancer device 19 may not directly be fastened to the cylinder block bottom wall 14. If the balancer device 19 is consequently fastened to the bearing cap bridge 16, supporting rigidity of the balancer device 19 possibly lowers, possibly causing vibration or noise.

However, in this embodiment, the recesses 16*c* and 16*d* are formed by notching edge portions of the bearing cap bridge 16 from the second fastening portions 16*b* toward the first fastening portion 16*a* side, and the third fastening portions 20*a* for fastening the balancer device 19 to the cylinder block bottom wall 14 are arranged in the spaces R1 to R4, which are demarcated by the first imaginary lines L1 which pass through the second fastening portions 16*b* and are orthogonal to crankshaft axial line A, and outlines of the recesses 16*c* and 16*d*. Thus, it becomes possible to directly screw the third bolts 23 into the cylinder block bottom wall 14 without interference with the bearing cap bridge 16. As a result, it becomes possible to tightly fasten the balancer device 19 to the cylinder block bottom wall 14 with high rigidity, and vibration of the balancer device 19 as a vibration source may effectively be reduced.

Further, the second fastening portions 16*b* are offset from the second imaginary lines L2 that pass through the first fastening portions 16*a* and are orthogonal to the crankshaft axial line A. Thus, the positions of the first fastening portions 16*a* and the second fastening portions 16*b* are not. locally concentrated but are dispersed, fastening rigidity of the balancer device 19 is further enhanced, and vibration may thereby be reduced. In addition, the positions of the four second bolts 18 that fix the bearing cap bridge 16 to the skirt portion 12 are offset from the second imaginary lines L2. Thus, the fastening forces of the second bolts 18 are prevented from being directly exerted on the bearing caps 15 positioned on the second imaginary lines L2, the fastening forces are dispersed to two bearing caps 15 that are separated to both sides in the crankshaft axial line A direction, and distortion of the bearing caps 15 may thereby be minimized.

In the foregoing, the embodiment of the present disclosure is described. However, various alterations in design of the present disclosure may be carried out in the scope that does not depart from the gist of the present disclosure.

For example, in the embodiment, an in-line four-cylinder engine is described as an example. However, the present disclosure may be applied to any form of engine.

Further, the bearing cap bridge 16 of the embodiment includes four recesses 16*c* and 16*d*. However, the number of recesses 16*c* and 16*d* is not limited to four.

Further, the recesses 16*c* and 16*d* in both of the side edges of the bearing cap bridge 16 of the embodiment are formed into symmetrical shapes across crankshaft axial line A. However, the shapes of the recesses 16*c* and 16*d* do not necessarily have to be symmetrical shapes.

Further, the engine auxiliary device of the present disclosure is not limited to the balancer device 19 of the embodiment but may be another engine auxiliary device such as an oil pump, which is driven by the crankshaft 13.

What is claimed is:

1. A cylinder block structure of an engine, the cylinder block structure comprising:

a cylinder block having a cylinder block bottom wall;

plural bearing caps configured to support a crankshaft that is disposed between the cylinder block and the plural bearing caps;

an engine auxiliary device fastened to the cylinder block bottom wall and configured to be driven by the crankshaft;

a bearing cap bridge fastened to the cylinder block bottom wall and configured to couple the plural bearing caps with one another;

first fastening portions configured to fasten the bearing cap bridge to both of the cylinder block bottom wall and the plural bearing caps;

second fastening portions configured to fasten the bearing cap bridge to the cylinder block bottom wall; and third fastening portions configured to fasten the engine auxiliary device to the cylinder block bottom wall, wherein the bearing cap bridge has edge portions extending with outlines recessed from the second fastening portions toward the first fastening portions, and when seen in an orthogonal direction to the cylinder block bottom wall, the third fastening portions are arranged within regions defined by the recessed outlines and first imaginary lines which pass through the second fastening portions and are orthogonal to an axial line of the crankshaft.

2. The cylinder block structure of the engine according to claim 1, wherein when seen in the orthogonal direction to the cylinder block bottom wall, the second fastening portions are offset from second imaginary lines that pass through the first fastening portions and are orthogonal to the axial line of the crankshaft.

3. The cylinder block structure of the engine according to claim 1, wherein the engine auxiliary device is a balancer device or an oil pump.

* * * * *